US006213346B1

(12) United States Patent
Skerrett et al.

(10) Patent No.: US 6,213,346 B1
(45) Date of Patent: Apr. 10, 2001

(54) INTERFOLDED DISPENSER NAPKINS

(75) Inventors: John Richard Skerrett; Micharl Yuwah Chan, both of Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/106,978

(22) Filed: Jun. 29, 1998

(51) Int. Cl.[7] ..... A47R 10/24; B65H 1/00
(52) U.S. Cl. ..... 221/48; 428/126; 428/130
(58) Field of Search ..... 221/48; 428/126, 428/130

(56) References Cited

U.S. PATENT DOCUMENTS

| | | | | |
|---|---|---|---|---|
| 1,253,644 | | 1/1918 | Straubel . | |
| 1,302,240 | | 4/1919 | Swick . | |
| 1,302,241 | | 4/1919 | Swick . | |
| 1,381,307 | * | 6/1921 | Hudson | 221/48 |
| 1,430,709 | * | 10/1922 | Wheeler | 221/48 |
| 1,457,978 | | 6/1923 | Lazar . | |
| 1,484,069 | | 2/1924 | Hudson . | |
| 1,516,779 | | 11/1924 | Nichol . | |

(List continued on next page.)

FOREIGN PATENT DOCUMENTS

| | | |
|---|---|---|
| 88-11735 | 8/1988 | (AU) . |
| 88-16037 | 11/1988 | (AU) . |
| 88-20273 | 2/1989 | (AU) . |
| 553900 | 3/1958 | (CA) . |
| 444751 | 5/1927 | (DE) . |
| 0287766 A1 | 10/1988 | (EP) . |
| 0291211 A2 | 11/1988 | (EP) . |
| 731344 | 6/1955 | (GB) . |
| 731410 | 6/1955 | (GB) . |
| 1225591 | 3/1971 | (GB) . |

OTHER PUBLICATIONS

Counterpart PCT International Search Report, mailed Oct. 13, 1999.

*Primary Examiner*—Christopher P. Ellis
*Assistant Examiner*—Joe Dillon
(74) *Attorney, Agent, or Firm*—Scott B. Garrison

(57) ABSTRACT

The present invention provides a napkin assembly for a dispenser. The napkin assembly may include a first napkin sheet further including a plurality of napkins and a second napkin sheet further including a plurality of napkins. Each napkin of both sheets having a basis weight from about 20 gsm to about 40 gsm may be connected to an adjacent napkin in series by a plurality of tabs. The second napkin sheet may be positioned proximate to the first napkin sheet in an offset relation and the first and second napkin sheets may be formed into a nested configuration for dispensing.

8 Claims, 4 Drawing Sheets

U.S. PATENT DOCUMENTS

| | | | | |
|---|---|---|---|---|
| 1,525,040 | | 2/1925 | Painter . | |
| 1,546,807 | * | 7/1925 | Straubel | 221/48 |
| 2,050,030 | * | 8/1936 | Winter | 221/48 |
| 2,092,167 | * | 9/1937 | Kettles | 221/48 |
| 2,092,952 | | 9/1937 | Campbell . | |
| 2,468,254 | | 4/1949 | Deloye . | |
| 2,626,145 | | 1/1953 | Sabee . | |
| 3,163,413 | | 12/1964 | Franke et al. . | |
| 3,195,882 | | 7/1965 | Nystrand . | |
| 3,338,575 | | 8/1967 | Nystrand et al. . | |
| 3,490,762 | | 1/1970 | Nystrand . | |
| 3,572,681 | | 3/1971 | Nystrand . | |
| 3,701,622 | | 10/1972 | Ducasse . | |
| 3,709,077 | | 1/1973 | Trogan et al. . | |
| 4,070,014 | | 1/1978 | Takahashi . | |
| 4,163,548 | | 8/1979 | Nystrand . | |
| 4,190,241 | | 2/1980 | Krueger . | |
| 4,204,699 | | 5/1980 | Gustafson . | |
| 4,254,947 | | 3/1981 | Trogan . | |
| 4,270,744 | | 6/1981 | Trogan . | |
| 4,279,411 | | 7/1981 | Nystrand . | |
| 4,329,001 | | 5/1982 | Filipowicz et al. . | |
| 4,475,730 | | 10/1984 | Trogan . | |
| 4,494,741 | | 1/1985 | Fischer et al. . | |
| 4,681,240 | | 7/1987 | Wyant . | |
| 4,691,908 | | 9/1987 | Bradley . | |
| 4,700,939 | | 10/1987 | Hathaway . | |
| 4,717,135 | | 1/1988 | Hathaway . | |
| 4,725,469 | | 2/1988 | Summerfield . | |
| 4,770,402 | | 9/1988 | Couturier . | |
| 4,778,441 | | 10/1988 | Couturier . | |
| 4,811,871 | | 3/1989 | Wass et al. . | |
| 4,917,665 | | 4/1990 | Couturier . | |
| 4,953,747 | | 9/1990 | Wenkman et al. . | |
| 5,011,017 | | 4/1991 | Giesen . | |
| 5,067,698 | | 11/1991 | Stemmler . | |
| 5,088,707 | | 2/1992 | Stemmler . | |
| 5,090,592 | | 2/1992 | Petterson et al. . | |
| 5,118,554 | | 6/1992 | Chan et al. . | |
| 5,147,273 | | 9/1992 | Rottmann et al. . | |
| 5,476,697 | | 12/1995 | Bellander . | |
| 5,690,250 | | 11/1997 | Gooding, Jr. et al. . | |
| 5,716,691 | | 2/1998 | Chan | 428/126 |

* cited by examiner

INTERFOLDED DISPENSER NAPKINS

FIELD OF THE INVENTION

This invention generally relates to the field of paper products, and more specifically, to dispenser napkins.

BACKGROUND

Dispensers may be used to provide napkins in settings such as restaurants and stadiums. Typically, the napkins are folded and stacked together, and then loaded into a dispenser. The user grasps the edge of the leading napkin in the dispenser opening for obtaining a napkin.

However, these stacked arrangements of napkins suffer several disadvantages. Often, the user cannot find an edge or flap of the leading napkin. As a result, the user pinches several napkins and removes them from the dispenser instead of dispensing the napkins one-at-a-time. Often, this is more napkins than the user needs. Consequently, napkins are wasted, which in turn, increases costs to the establishment owner. Furthermore, some napkins if improperly loaded may not properly dispense. As an example, loading a stack of napkins backward may not present an edge or a flap for a user to grasp. Consequently, the napkins must be removed from the dispenser and reloaded.

Accordingly, a stacked napkin arrangement that provides consistent one-at-a-time napkin dispensing to reduce waste and costs and variable loading arrangements will improve over conventional stacked napkins.

Definitions

As used herein, the term "cellulosic material" refers to material that may be prepared from cellulose fibers from synthetic source or natural sources, such as woody and non-woody plants. Woody plants include, for example, deciduous and coniferous trees. Non-woody plants include, for example, cotton, flax, esparto grass, milkweed, straw, jute, hemp, and bagasse. The cellulose fibers may be modified by various treatments such as, for example, thermal, chemical and/or mechanical treatments. It is contemplated that reconstituted and/or synthetic cellulose fibers may be used and/or blended with other cellulose fibers of the fibrous cellulosic material. Desirably, no synthetic fibers are woven into the cellulosic material fibers.

As used herein, the term "pulp" refers to cellulosic fibrous material from sources such as woody and non-woody plants. Woody plants include, for example, deciduous and coniferous trees. Non-woody plants include, for example, cotton, flax, esparto grass, milkweed, straw, jute, hemp, and bagasse. Pulp may be modified by various treatments such as, for example, thermal, chemical and/or mechanical treatments. Desirably, no synthetic fibers are woven into the pulp fibers.

As used herein, the term "nonwoven web" refers to a web that has a structure of individual fibers or filaments which are interlaid forming a matrix, but not in an identifiable repeating manner. Nonwoven webs have been, in the past, formed by a variety of processes known to those skilled in the art such as, for example, meltblowing, spunbonding, wet-forming and various bonded carded web processes.

As used herein, the term "spunbonded web" refers to a web of small diameter fibers and/or filaments which are formed by extruding a molten thermoplastic material as filaments from a plurality of fine, usually circular, capillaries in a spinneret with the diameter of the extruded filaments then being rapidly reduced, for example, by non-eductive or eductive fluid-drawing or other well known spunbonding mechanisms. The production of spunbonded nonwoven webs is illustrated in patents such as Appel, et al., U.S. Pat. No. 4,340,563.

As used herein, the term "meltblown fibers" means fibers formed by extruding a molten thermoplastic material through a plurality of fine, usually circular, die capillaries as molten threads or filaments into a high-velocity gas (e.g. air) stream which attenuates the filaments of molten thermoplastic material to reduce their diameters, which may be to microfiber diameter. Thereafter, the meltblown fibers are carried by the high-velocity gas stream and are deposited on a collecting surface to form a web of randomly disbursed meltblown fibers. The meltblown process is well-known and is described in various patents and publications, including NRL Report 4364, "Manufacture of Super-Fine Organic Fibers" by V. A. Wendt, E. L. Boone, and C. D. Fluharty; NRL Report 5265, "An Improved Device for the Formation of Super-Fine Thermoplastic Fibers" by K. D. Lawrence, R. T. Lukas, and J. A. Young; and U.S. Pat. No. 3,849,241, issued Nov. 19, 1974, to Buntin, et al.

As used herein, the term "basis weight" (hereinafter may be referred to as "BW") is the weight per unit area of a sample and may be reported as gram-force per meter squared and may be hereinafter abbreviated as "$g_f$ms". The basis weight may be calculated using test procedure ASTM D 3776-96.

As used herein, the term "napkin assembly" refers to a stacked, interfolded arrangement of napkins, which may be in the form of napkin sheets.

As used herein, the term "napkin sheet" refers to a plurality of napkins connected together in series by a plurality of tabs separated by slits perforating the sheet. Individual napkins may be separated at the perforations during dispensing. The napkin sheet may include one or more plies.

As used herein, the term "machine direction" (hereinafter may be referred to as "MD") is the direction of a material parallel to its forward direction during processing.

As used herein, the term "machine direction tensile" (hereinafter may be referred to as "MDT") is the breaking force in the machine direction required to rupture a three inch width specimen. The results may be reported as gram-force and abbreviated as "gf". The MDT may be determined using test method number ASTM D5035-95.

As used herein, the term "tab strength" is the breaking force in the machine direction required to rupture a sheet product along its perforations. The results may be reported as gram-force and abbreviated as "gf". The MDT may be determined using test method number ASTM D5035-95.

As used herein, the term "tab width to slit width ratio" (hereinafter may be referred to as "T/S") refers to the ratio of the average width of a tab divided by the average width of a slit for a paper product.

As used herein, the term "caliper" refers to the thickness measurement of a sheet taken under constant force. The caliper may be determined using test method number TAPPI 411-OM-89.

SUMMARY OF THE INVENTION

The problems and needs described above are addressed by the present invention, which provides a napkin assembly for a dispenser. The napkin assembly may include a first napkin sheet further including a plurality of napkins and a second napkin sheet further including a plurality of napkins. Each napkin of both sheets has a basis weight from about 20 gsm to about 40 gsm and may be connected to an adjacent napkin in series by a plurality of tabs. The second napkin sheet may be positioned proximate to the first napkin sheet in an offset relation and the first and second napkin sheets may be formed into a nested configuration for dispensing.

Furthermore, each napkin of the first and second napkin sheets may include a first member integrally formed with a second member. These members may form a fold therebetween. At least one napkin from the first napkin sheet may terminate at about the fold of a respective napkin from the second napkin sheet.

Moreover, at least 500 napkins from the first napkin sheet may terminate at about the fold of a respective napkin from the second napkin sheet.

In addition, the napkin basis weight may be about 30 gsm, the machine direction tensile may be greater than about 2000 $g_f$, the T/S ratio may be greater than about 0.03, and the tab strength may be greater than about 30 $g_f$. What is more, the napkins may include pulp fibers.

Another embodiment of a napkin assembly for a dispenser may include a first napkin sheet further including a plurality of napkins and a second napkin sheet further including a plurality of napkins. Each napkin of both sheets may be connected to an adjacent napkin in series by a plurality of tabs. What is more, each napkin of the first and second napkin sheets may include a first member, a second member, and a third member wherein the first member may be formed integrally with the second member forming a first fold between the first and second members and the second member may be formed integrally with the third member forming a second fold between the second and third members. At least one napkin from the first napkin sheet may terminate at about the second fold of a respective napkin from the second napkin sheet when nestably configured for dispensing.

Furthermore, at least 500 napkins from the first napkin sheet may terminate at about the second fold of a respective napkin from the second napkin sheet. Also, the napkin basis weight may be from about 20 gsm to about 40 gsm. Moreover, the napkin basis weight may be about 30 gsm, the machine direction tensile may be greater than about 2000 $g_f$, the T/S ratio may be greater than about 0.03, and the tab strength may be greater than about 30 $g_f$. Additionally, the napkins may include pulp fibers.

A further embodiment of the present invention is a napkin assembly for a dispenser. The napkin assembly may include a first napkin sheet further including a plurality of napkins and a second napkin sheet further including a plurality of napkins. Each napkin may be connected to an adjacent napkin in series by a plurality of tabs. What is more, each napkin of the first and second napkin sheets may include a first member, a second member, a third member, and a fourth member. The first member may be formed integrally with the second member forming a first fold between the first and second members, the second member may be formed integrally with the third member forming a second fold between the second and third members, and the third member may be formed integrally with the fourth member forming a third fold between the third and fourth members. The second and third members may have a length about twice that of the first and fourth members. At least one napkin from the first napkin sheet may terminate at about the middle of a third member of a respective napkin from the second napkin sheet when nestably configured for dispensing.

Furthermore, at least 500 napkins from the first napkin sheet may terminate at about the middle of a third member of a respective napkin from the second napkin sheet. Additionally, the napkin basis weight may be from about 20 gsm to about 40 gsm. Likewise, the napkin basis weight may be about 30 gsm, the machine direction tensile may be greater than about 2000 $g_f$, the T/S ratio may be greater than about 0.03, and the tab strength may be greater than about 30 $g_f$. In addition, the napkins may include pulp fibers.

DETAILED DESCRIPTION OF THE PREFERRED EMBODIMENT(S)

Figure 1:
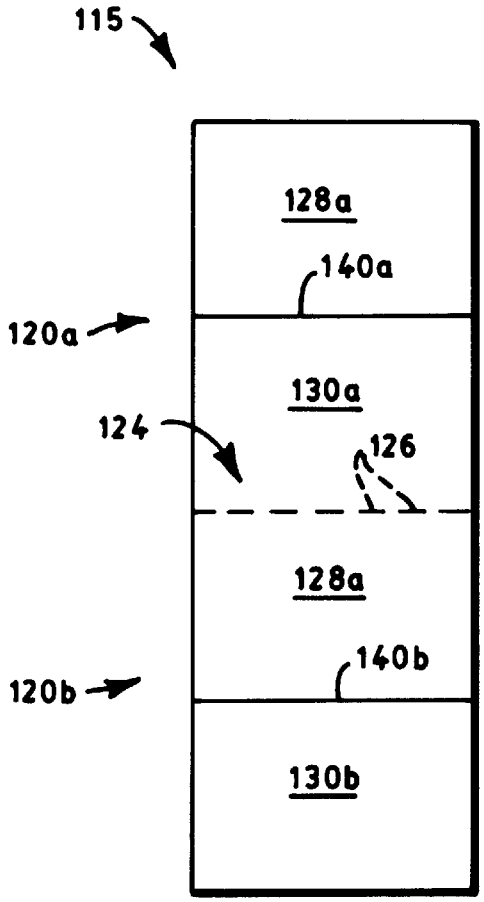
FIG. 1 is a front, plan view, but not necessarily to scale, of one embodiment of a plurality of napkins.
Figure 2:
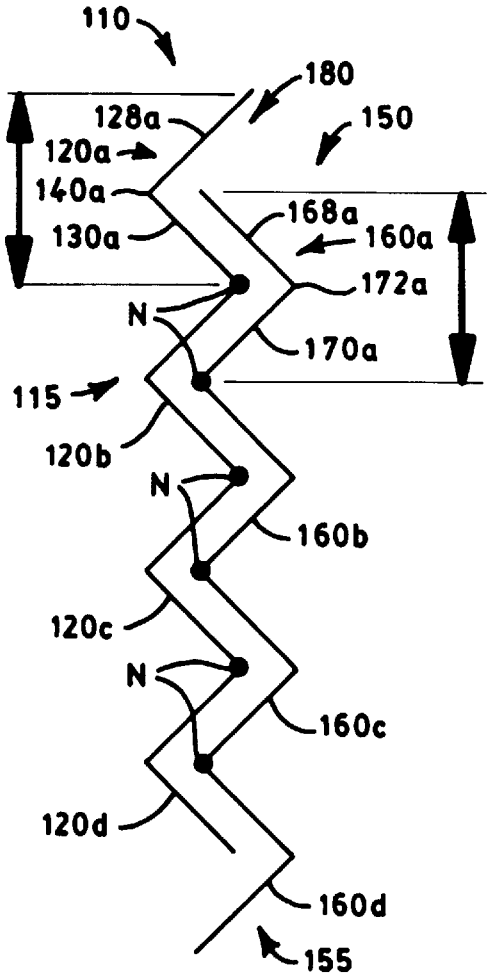
FIG. 2 is a side, exploded view, but not necessarily to scale, of one embodiment of a napkin assembly having two interfolded napkin sheets.
Figure 3:
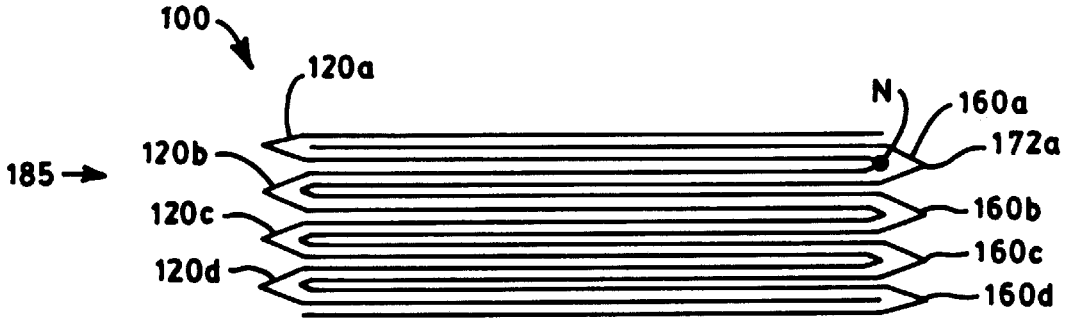
FIG. 3 is a side, elevational view, but not necessarily to scale, of one embodiment of a napkin assembly in a nested configuration.

Referring now to the drawings, like reference numerals designate corresponding structure throughout the views and like reference numerals used in conjunction with sequentially ordered lower case letters refer to a series of substantially identical items or components. Referring in particular to FIGS. 1–3, there is depicted a napkin assembly 100 having a first napkin sheet 110 and a second napkin sheet 150. The first and second napkin sheets 110 and 150 may be substantially identical. As a result, only the first napkin sheet 110 is discussed in detail hereinafter.

The first napkin sheet 110 may include a plurality of napkins 115. Referring to FIGS. 2 and 3, nodes (identified by the letter "N") may be placed on the drawings to merely indicate perforations or slits 126 separating individual napkins. These nodes are not actually present on the desired embodiments.

Referring to FIG. 1, there is shown a portion of a napkin sheet 110 depicting a plurality of napkins 115 that may include napkins 120*a* and 120*b*. The napkins may be attached together with a plurality of tabs 124. These tabs may be separated by a plurality of slits 126 perforating the sheet 110. The tabs 124 may range from about 1 millimeter to about 10 millimeter and may be manufactured by any method readily recognizable to one of ordinary skill in the art. Furthermore, although the tabs 124 are depicted as having the same length and as evenly spaced across the sheet 110, it should be understood that the tabs 124 may be of various sizes or unevenly spaced in alternative embodiments. As an example, the tabs 124 may be positioned on only one half of the sheet 110. In addition, the tabs 124 may be varied in size in relation to the slits 126 depending upon the properties of the sheet 110. As an example, some or all of the tabs 124 may have a length twice that of an adjacent slit 126. This tabbed structure may permit separating the napkins 120*a* and 120*b* during dispensing and may be used to connect subsequent napkins, such as the napkins 120*c* and 120*d,* as well. Napkins 120*a* and 120*b* may be substantially identical, consequently, only napkin 120*a* is discussed in detail hereinafter.

The napkin 120*a* may include a first member 128*a* and a second member 130*a*. The members 128*a* and 130*a* having approximately the same dimensions may be formed integrally together creating a fold 140*a* therebetween. The fold 140*a* may permit the napkin 120*a* from the first sheet 110 to be interfolded with a napkin 160*a* from the second sheet 150.

The first and second napkin sheets 110 and 150 may be interfolded to form a nested configuration 185 as shown in FIG. 3. Although the depicted napkin assembly 100 consists of eight napkins, desirably the napkin assembly 100 may include from about 200 to about 1000 napkins. Furthermore, it is contemplated that even larger numbers of napkins may be used.

Referring to FIGS. 2 and 3, the sheets 110 and 150 may be positioned in an offset relation 180. The second sheet 150 may include a plurality of napkins 155 where each napkin 160*a–d* may include, respectively, a first member 168*a–d,* a second member 170*a–d,* and a fold 172*a–d,* similar to the previously described napkins 120*a–d* of the first napkin sheet 110. When the assembly 100 is formed into the nested configuration 185, the napkin 120*a* may terminate at tabs 124 at about the corresponding location of the fold 172*a* of the napkin 160*a*. This position may align the perforated section of the napkin 120*a* with the fold 172*a* of the napkin 160*a*. Napkins 120*b–d* of the first sheet 110 may terminate in the same manner to correspond with respective napkins 160*b–d* of the second sheet 150.

Figure 4:
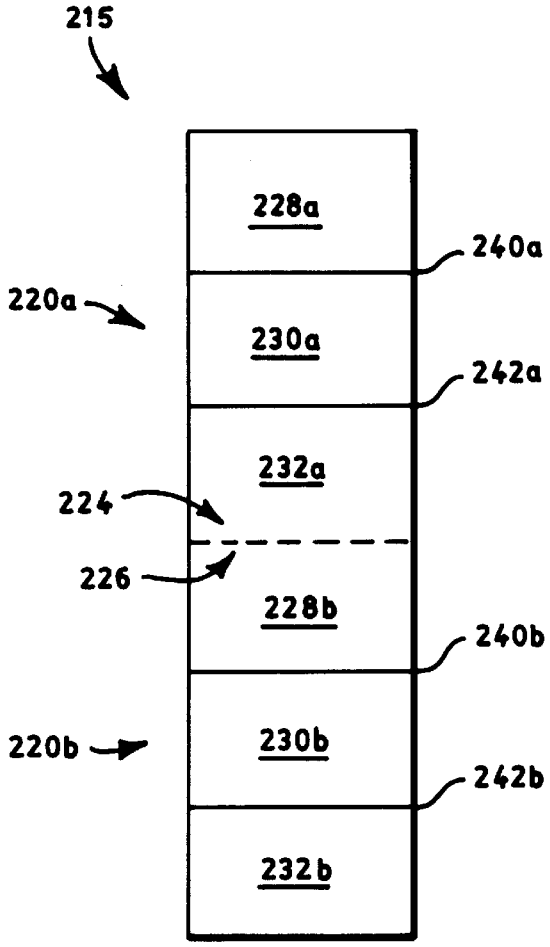
FIG. 4 is a front, plan view, but not necessarily to scale, of a second embodiment of a plurality of napkins.
Figure 5:
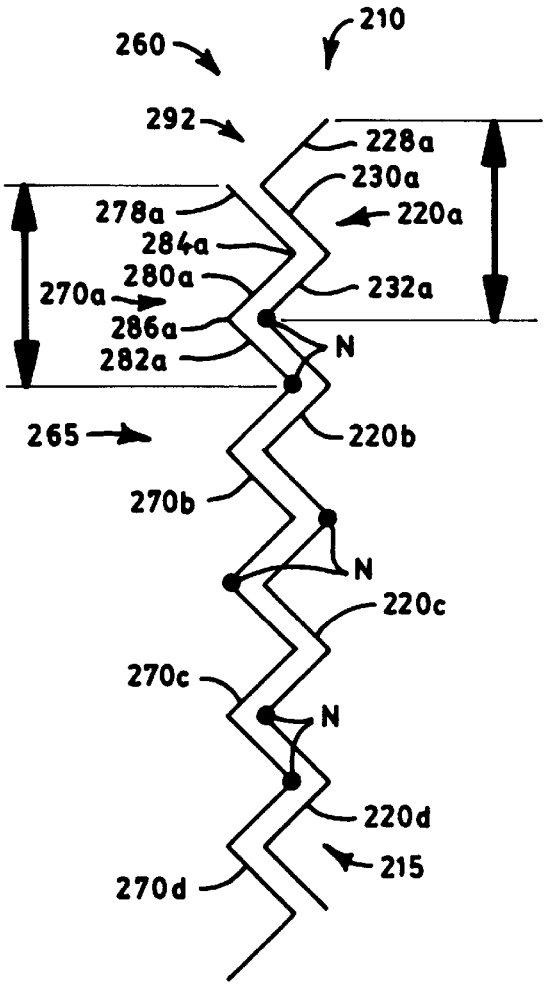
FIG. 5 is a side, exploded view, but not necessarily to scale, of a second embodiment of a napkin assembly having two interfolded napkin sheets.
Figure 6:
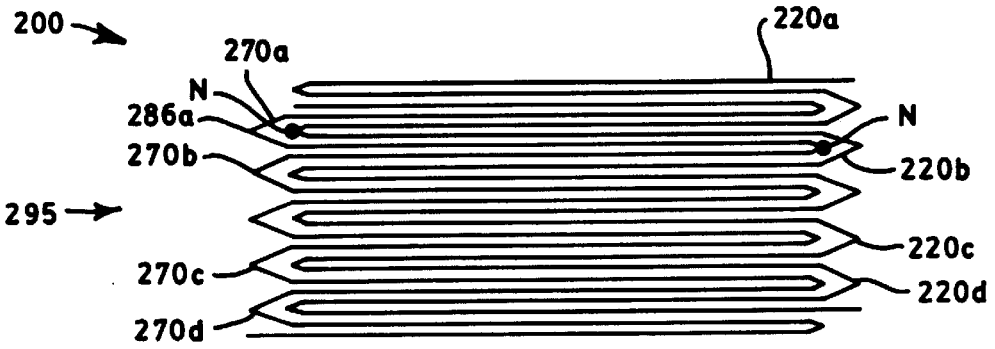
FIG. 6 is a side, elevational view, but not necessarily to scale, of a third embodiment of a napkin assembly in a nested configuration.

Referring to FIGS. 4–6, there is depicted another napkin assembly 200 having a first napkin sheet 210 and a second napkin sheet 260. The first and second napkin sheets 210 and 260 may be substantially identical. As a result, only the first napkin sheet 210 is discussed in detail hereinafter.

The first napkin sheet 210 may include a plurality of napkins 215. Ref erring to FIGS. 5 and 6, nodes "N" are placed on the drawings to merely indicate the perforations or slits 226 separating individual napkins. These nodes are not actually present on the desired embodiments.

Referring to FIG. 4, there is shown a portion of a napkin sheet 210 depicting a plurality of napkins 215 that may include napkins 220*a* and 220*b*. The napkins 220*a* and 220*b* may be attached together with a plurality of tabs 224. These tabs 224 may be separated by a plurality of slits 226 perforating the sheet 210. The tabs 224 may range from about 1 millimeter to about 10 millimeter and may be manufactured by any method readily recognizable to one of ordinary skill in the art. Furthermore, although the tabs 224 are depicted as having the same width and as evenly spaced across the sheet 210, it should be understood that the tabs 224 may be of various sizes or unevenly spaced in alternative embodiments. As an example, the tabs 224 may be positioned on only one half of the sheet 210. In addition, the tabs 224 may be varied in size in relation to the slits 226 depending upon the properties of the sheet 210. As an example, some or all of the tabs 224 may have a length twice that of an adjacent slit 226. This tabbed structure may permit separating the napkins 220*a* and 220*b* during dispensing and may be used to connect subsequent napkins, such as napkins 220*c* and 220*d,* as well. Napkins 220*a* and 220*b* may be substantially identical, consequently, only napkin 220*a* is discussed in detail hereinafter.

The napkin 220*a* may include a first member 228*a,* a second member 230*a,* and a third member 232*a*. The members 228*a,* 230*a,* and 232*a* having approximately the same dimensions may be formed integrally together. Members 228*a* and 230*a* may form a fold 240*a* and members 230*a* and 232*a* may form a fold 242*a*. The folds 240*a* and 242*a* may permit the napkin 220*a* from the first sheet 210 to be interfolded with a napkin 270*a* from the second sheet 260.

The first and second napkin sheets 210 and 260 may be interfolded to form a nested configuration 295 as shown in FIG. 6. Although the depicted napkin assembly 200 consists of eight napkins, desirably the napkin assembly 200 may include from about 200 to about 1000 napkins. Furthermore, it is contemplated that even larger numbers of napkins may be used.

Referring to FIGS. 5 and 6, the sheets 210 and 260 may be positioned in an offset relation 292. The second napkin sheet 260 may include a plurality of napkins 265 where each napkin 270*a–d* may include a first member 278*a–d,* a second member 280*a–d,* a third member 282*a–d*, a first fold 284*a–d*, and a second fold 286*a–d*, similar to the previously described napkins 220*a–d* of the first napkin sheet 210. When the assembly 200 is formed into the nested configuration 295, the napkin 220*a* may terminate at tabs 224 at about the corresponding location of the second fold 286*a* of the second sheet napkin 270*a*. This position may align the perforated section of the napkin 220*a* with the fold 286*a* of the napkin 270*a*. Napkins 220*b–d* of the first sheet 210 may terminate in the same manner to correspond with respective napkins 270*b–d* of the second sheet 260.

Figure 7:
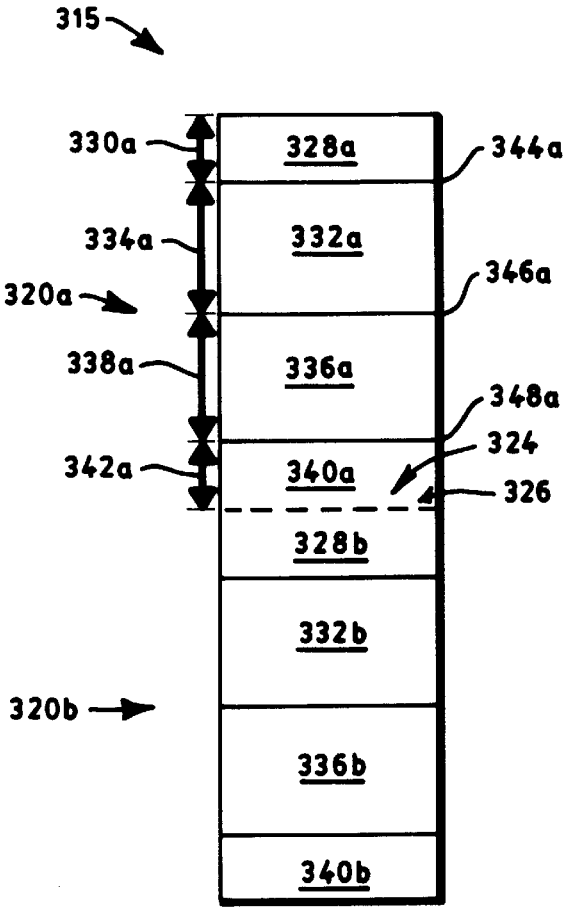
FIG. 7 is a front, plan view, but not necessarily to scale, of a third embodiment of a plurality of napkins.
Figure 8:
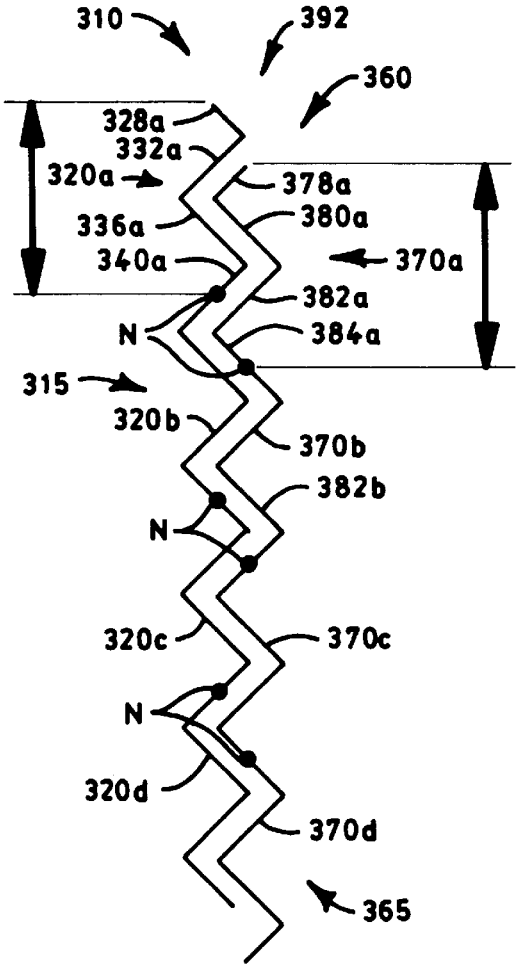
FIG. 8 is a side, exploded view, but not necessarily to scale, of a third embodiment of a napkin assembly having two interfolded napkin sheets.
Figure 9:
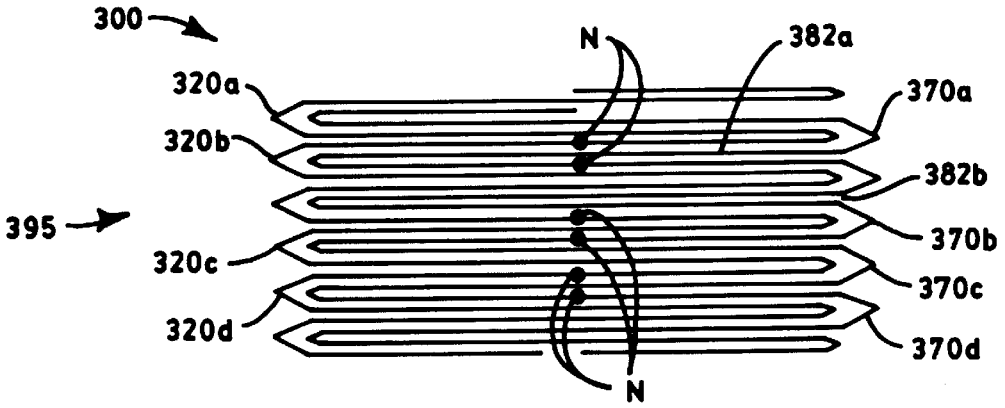
FIG. 9 is a side, elevational view but not necessarily to scale, of a third embodiment of a napkin assembly in a nested configuration.
Figure 10:
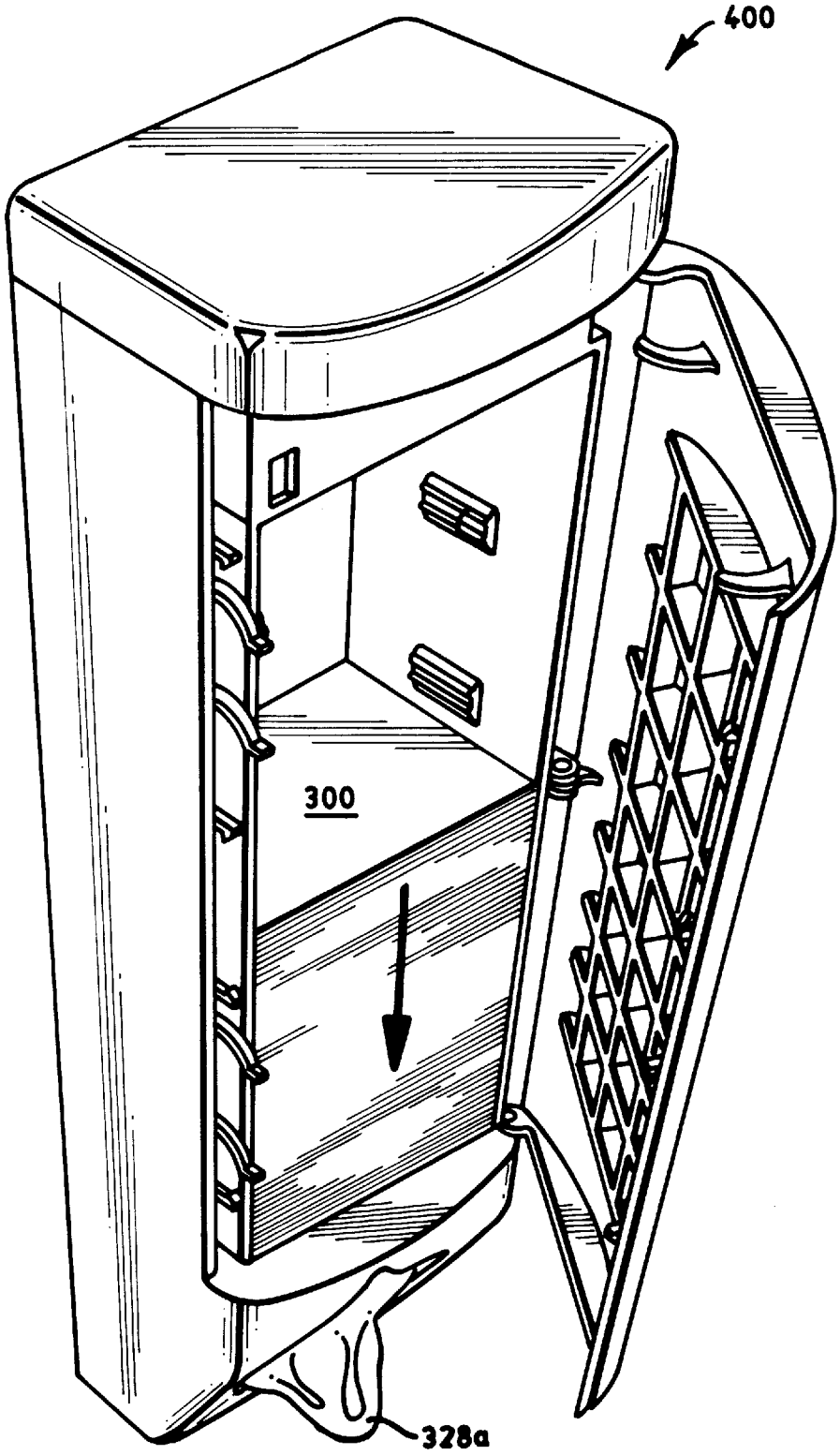
FIG. 10 is a perspective view of an open napkin dispenser housing a napkin assembly.

Referring to FIGS. 7–9, there is depicted a further napkin assembly 300 having a first napkin sheet 310 and a second napkin sheet 360. The first and second napkin sheets 310 and 360 may be substantially identical. As a result, only the first napkin sheet 310 is discussed in detail hereinafter.

The first napkin sheet 310 may include a plurality of napkins 315. Referring to FIGS. 8 and 9, nodes "N" are placed on the drawings to merely indicate perforations separating individual napkins. These nodes are not actually present on the desired embodiments.

Referring to FIG. 7, there is shown a portion of a napkin sheet 310 depicting a plurality of napkins 215 that may include napkins 320*a* and 320*b*. The napkins 320*a* and 320*b* may be attached together with a plurality of tabs 324. These tabs 324 may be separated by a plurality of slits 326 perforating the sheet 310. The tabs 324 may range from about 1 millimeter to about 10 millimeter and may be manufactured by any method readily recognizable to one of ordinary skill in the art. Furthermore, although the tabs 324 are depicted as having the same width and as evenly spaced across the sheet 310, it should be understood that the tabs 324 may be of various sizes or unevenly spaced in alternative embodiments. As an example, the tabs 324 may be positioned on only one half of the sheet 310. In addition, the tabs 324 may be varied in size in relation to the slits 326 depending upon the properties of the sheet 310. As an example, some or all of the tabs 324 may have a length twice that of an adjacent slit 326. This tabbed structure may permit separating the napkins 320*a* and 320*b* during dispensing and may be used to connect subsequent napkins, such as napkins 320*c* and 320*d*, as well. Napkins 320*a* and 320*b* may be substantially identical, consequently, only napkin 320*a* is discussed in detail hereinafter.

The napkin 320*a* may include a first member 328*a*, a second member 332*a*, a third member 336*a*, and a fourth member 340*a*. The members 328*a*, 332*a*, 336*a*, and 340*a* may be formed integrally together. Members 328*a* and 332*a* may form a fold 344*a*, members 332*a* and 336*a* may form a fold 346*a*, and members 336*a* and 340*a* may form a fold 348*a*. The lengths 330*a* and 342*a* of respective members 328*a* and 340*a* may be about half the length 334*a* and 338*a* of respective members 332*a* and 336*a*. The folds 344*a*, 346*a*, and 348*a* may permit the napkin 320*a* from the first sheet 310 to be interfolded with a napkin 370*a* from the second sheet 360.

The first and second napkin sheets 310 and 360 may be interfolded to form a nested configuration 395 as shown in FIG. 9. Although the napkin assembly 300 consists eight napkins, desirably the napkin assembly 300 may include from about 200 to about 1000 napkins. Furthermore, it is contemplated that even larger numbers of napkins may be used.

Referring to FIGS. 8 and 9, the sheets 310 and 360 may be positioned in an offset relation 392. The second napkin sheet 360 may include a plurality of napkins 365 where each napkin 370*a–d* may include a first member 378*a–d*, a second member 380*a–d*, a third member 382*a–d*, and a fourth member 384*a–d*, similar to the previously described napkins 320*a–d* of the first napkin sheet 310. When the assembly 300 is formed into the nested configuration 395, the napkin 320*a* may terminate at tabs 324 at about the corresponding location of the middle of the third member 382*a* of the napkin 370*a*. This positions may align the perforated section of the napkin 320*a* with about the midpoint of the member 382*a*. Napkins 320*b–d* of the first sheet 310 may terminate in the same manner to correspond with respective napkins 370*b–d* of the second sheet 360.

The napkins may be constructed from cellulosic fibers, nonwoven materials, or combinations of both materials. The basis weight of the napkins may vary from about 10 gram-force per square meter (hereinafter may be abbreviated as "gsm") to about 50 gsm, desirably from about 20 gsm to about 40 gsm, and more desirably about 30 gsm.

These napkins may be interfolded using any method or machine known by one of ordinary skill in the art, such as those disclosed by U.S. Pat. Nos. 1,253,644, 1,302,241, and 1,457,978, which are hereby incorporated by reference.

An exemplary napkin dispenser 400, which is disclosed in application Ser. No. 08/991,669, entitled, "Container And Cartridge For Dispensing Paper Product," hereby incorporated by reference, may hold a napkin assembly 300, although napkin assemblies 100 and 200 may be used as well. The dispenser 400 may be vertical with the napkins fed by gravity or horizontal with a spring to force napkins from the dispenser. A first member 328 of the napkin sheet 310 may protrude from the dispenser to be grasped by a user. Grasping and pulling the member 328*a* may pull a portion of the napkin 370*a* of the second sheet 360 from the dispenser 400. The user may pull the napkin 320*a* to tear along the tabs 324 for obtaining one napkin. Thus, the user may obtain a napkin 320*a* for use while still leaving a portion of the next napkin outside the dispenser for the next user to grasp. As a result, this invention may permit one-at-a-time napkin dispensing and minimize waste. It should be understood that the other napkin assemblies 100 and 200 operate in the same manner. In particular, removing one napkin from a sheet results in the positioning a napkin from the other sheet outside the dispenser 400 for grasping by a user. Furthermore, the napkin assemblies 200, 300, and 400 may be inverted so that either end may dispense individual napkins.

Comparison Data

Generally, the ratio of tab width to slit width (hereinafter may be referred to as "T/S") is greater in napkin assemblies of the present invention than toilet tissue products. The T/S value of napkins is generally 0.04 while the T/S value of toilet tissue products is generally 0.02. This higher ratio creates a stronger connection between napkins, which in turn, prevents inadvertent separation of the napkins within the dispenser during dispensing.

Table 1 depicts data from a napkin sheet of the present invention and an interfolded toilet tissue.

TABLE 1

| | Napkin | Toilet Tissue Product |
|---|---|---|
| Basis Weight ($g_f$) | 29 | 14 |
| Caliper (millimeter) | 0.20 | 0.064 |
| Machine Direction Tensile ($g_f$) | 5700 | 1200 |

As depicted, the napkin tends to have a higher basis weight, caliper measurement, and machine direction tensile than the toilet tissue product. Thus, the napkin has different physical properties created for its intended use, which may present different dispensing properties than toilet tissue.

Table 2 depicts data regarding perforated structure for the paper products of Table 1.

TABLE 2

| | Napkin | Toilet Tissue Product |
|---|---|---|
| Tab Width (millimeter) | 0.48 | 0.48 |
| Slit Width (millimeter) | 12 | 28 |
| Tab Strength ($g_f$) | 92 | 20 |

Although the tab widths for the napkin of the present invention and the toilet tissue product are the same, the slit width of the toilet tissue product is over twice that of the napkin, and likewise, the tab strength is less than a quarter of the napkin. Generally, greater slit widths in toilet tissue result in less tabs present in the sheet. Toilet tissue may be constructed with less tabs because of its smaller sheet size, which may require less pulling force during dispensing. Napkins tend to be bigger sheet products, and as a result, more force may be required to pull napkins from the dispenser. Thus, smaller slit widths, and thereby more tabs, may prevent unintentional napkin sheet separation during dispensing.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A napkin assembly for a dispenser, the napkin assembly comprising:

a first continuous napkin sheet further comprising a plurality of napkins wherein each napkin is connected to an adjacent napkin in series by a plurality of tabs;

a second continuous napkin sheet further comprising a plurality of napkins wherein each napkin is connected to an adjacent napkin in series by a plurality of tabs;

each napkin of the first and second napkin sheets further includes a first member, a second member, and a third member wherein the first member is formed integrally with the second member forming a first fold between the first and second members and the second member is formed integrally with the third member forming a second fold between the second and third members; and at least one napkin from the first napkin sheet terminates at the tabs connecting the third member of the napkin to the first member of the adjacent napkin at about the second fold of a respective napkin from the second napkin sheet when nestably configured for dispensing.

2. The napkin assembly of claim 1 wherein the napkins comprise pulp fibers.

3. The napkin assembly of claim 1 wherein the machine direction tensile is greater than about 2000 $g_f$.

4. The napkin assembly of claim 1 wherein the T/S ratio is greater than about 0.03.

5. The napkin assembly of claim 1 wherein the tab strength is greater than about 30 $g_f$.

6. The napkin assembly of claim 1 wherein at least 500 napkins from the first napkin sheet terminate at about the second fold of a respective napkin from the second napkin sheet.

7. The napkin assembly of claim 1 wherein the napkin basis weight is from about 20 gsm to about 40 gsm.

8. The napkin assembly of claim 1 wherein the napkin basis weight is about 30 gsm.

* * * * *